United States Patent [19]

Kobayashi

[11] 3,986,327

[45] Oct. 19, 1976

[54] SEPARATION OF DIRT FROM FIBERS IN SPINNING MACHINE

[75] Inventor: Akira Kobayashi, Ohbu, Japan

[73] Assignees: Kabushiki Kaisha Toyoda Jidoshokki Seisakusho, Kariya; Daiwa Boseki Kabushiki Kaisha, Osaka, both of Japan

[22] Filed: Oct. 29, 1974

[21] Appl. No.: 518,932

[30] Foreign Application Priority Data

Nov. 5, 1973 Japan ..... 48-127971

[52] U.S. Cl. ..... 57/56; 57/58.89

[51] Int. Cl.[2] ..... D01H 11/00; D01H 1/12

[58] Field of Search ..... 19/105, 89; 57/58.89–58.95, 56

[56] References Cited

UNITED STATES PATENTS

| | | | |
|---|---|---|---|
| 3,455,097 | 7/1969 | Rajonha et al. | 57/58.95 |
| 3,777,466 | 12/1973 | Kabele et al. | 57/58.89 |
| 3,785,138 | 1/1974 | Rajonha et al. | 57/58.89 X |
| 3,792,575 | 2/1974 | Doudlebsky et al. | 57/58.89 X |
| 3,797,218 | 3/1974 | Landwehrkamp et al. | 57/58.89 |
| 3,828,539 | 8/1974 | Croasdale et al. | 57/58.91 |

FOREIGN PATENTS OR APPLICATIONS

| | | | |
|---|---|---|---|
| 703,376 | 2/1954 | United Kingdom | 19/89 |
| 239,085 | 12/1969 | U.S.S.R. | 57/58.95 |

*Primary Examiner*—Dorsey Newton

*Attorney, Agent, or Firm*—Wenderoth, Lind & Ponack

[57] ABSTRACT

In a spinning device of an open end spinning machine, a sliver is fed to and passes through a feeding and opening device which opens it into individual fibers and feeds them into a rotary spinning chamber where they are collected and discharged as a finished yarn therefrom. In order to clean the fibers, when they pass through the feeding and opening device, dirt of the fibers is adapted to be thrown out by centrifugal force and leaves the fibers through a dirt discharge opening into a dirt collecting chamber. At this time, loss of fibers has to be prevented and for such purpose an air supply duct is arranged adjacent to the dirt discharge opening to introduce an air current into the fibers opposite to the direction of movement of the dirt particles. The air supply duct is adapted to allow the speed, the flow rate, and/or the direction of the air current to change in accordance with the conditions mentioned in the following description.

3 Claims, 7 Drawing Figures

FIG. 1
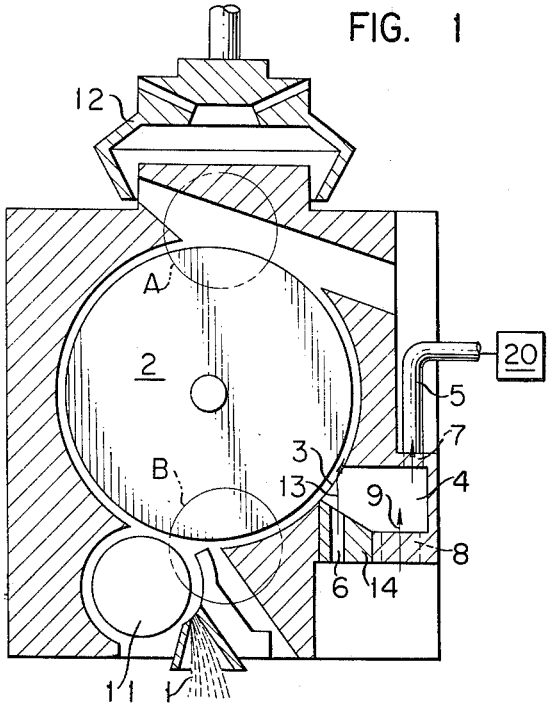
FIG. 2
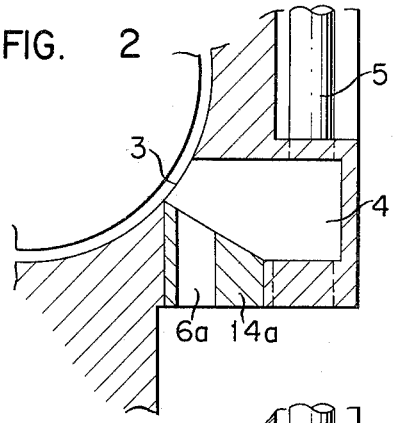
FIG. 3
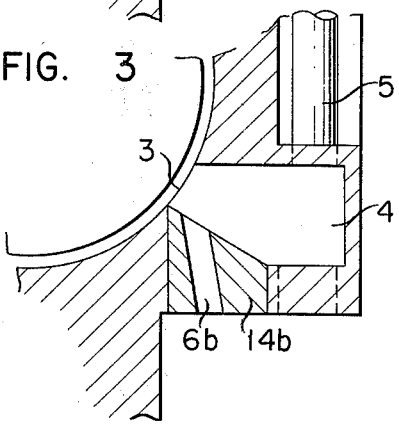
FIG. 5
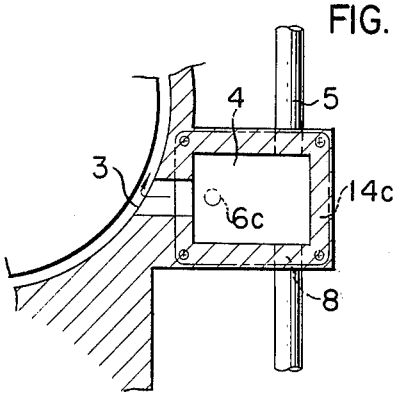
FIG. 4
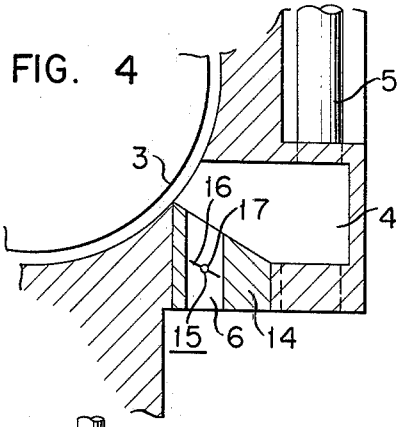
FIG. 6
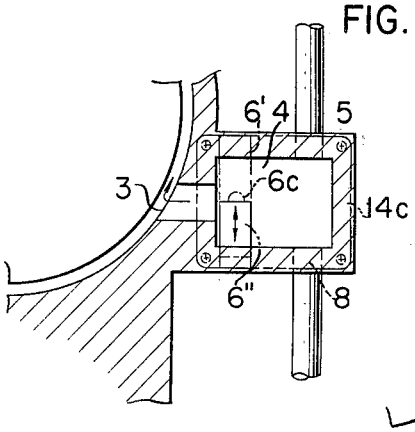
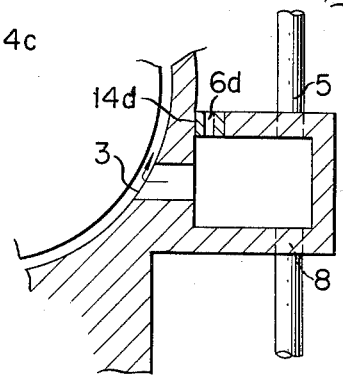
FIG. 7

SEPARATION OF DIRT FROM FIBERS IN SPINNING MACHINE

BACKGROUND OF THE INVENTION

This invention relates to a spinning device for open end spinning machines, and more particularly to a device for the separation of dirt from fibers in the spinning device.

As is well known in the art, there is a spinning device for an open end spinning machine of the type comprising a rotary spinning chamber, feeding and combing means for feeding a supplied sliver into the rotary spinning chamber, and a discharge channel through which the finished yarn is withdrawn. The feeding and combing means includes a combing roller to which the sliver is fed and combed out into individual fibers. By the combing roller, the individual fibers are fed to a removal position thereof and hence into the rotating spinning chamber. Along the path of the individual fibers to the removal position, there is a dirt discharging opening through which dirt contained in the sliver, such as husks, neps or short fibers having a length shorter than the width of the dirt discharge opening, is thrown out by centrifugal force toward a dirt collecting chamber. The dirt collecting chamber is provided with an air inlet and outlet to produce an air current flowing therethrough, thereby removing the dirt particles out of the dirt collecting chamber. In order to prevent the fibers from passing out through the dirt discharge opening, that is to carry out an efficient separation of the dirt from the fibers, there is provided in the housing for the feeding and combing means a dirt separating channel through which an air current is introduced into the fibers at a position near the dirt discharge opening. However, in fact, an amount of fibers passing out through the dirt discharge opening depends on various conditions, such as the circumferential speed of the combing roller, the magnitude of negative pressure provided by the negative pressure source, the type of material to be spun, and so on. It is therefore understood that if the dirt separating channel is always of the same configuration, regardless of the above-mentioned conditions, the rate of the fibers to the dirt particles in the dirt collecting chamber will be changed with the abovementioned conditions. Particularly, in the case where removal of fibers becomes excessive, the production rate of finished yarn is undesirably decreased.

SUMMARY OF THE INVENTION

An object of the invention is therefore to eliminate the above-mentioned disadvantage of the prior art spinning device.

According to an arrangement of the present invention, means for defining a separating channel consists of an exchangeable block or plate member which is not an integral part of the housing for the feeding and combining means, but which is mounted to the housing in a removable manner to be exhangeable with another, different block or plate member. A number of exchangeable block or plate members are provided for adaptation to various conditions, such as the circumferential speed of the combing roller, the value of negative pressure generated by a source of negative pressure, the type of fibers and so on, with the separating channels different from one another in their diameter and/or inclination.

In accordance with an preferred embodiment of the invention, the separating channel may be provided with means for controlling the amount of air flowing through the separating channel into the fibers.

BRIEF DESCRIPTION OF THE DRAWING

The invention will become more readily apparent from the following detailed description taken in conjunction with the accompanying drawing in which the similar reference numerals denote the same or corresponding components throughout the figures and in which:

FIG. 1 is a section showing a spinning device embodied the present invention; and FIGS. 2 to 7 are fragmental sections illustrating various embodiments of the invention.

DESCRIPTION OF THE PREFERRED EMBODIMENTS

Referring now to the drawings, there is shown in FIG. 1 a spinning device for an open end spinning machine which is provided with a dirt removing device constructed in accordance with the principles of the invention. A sliver 1 supplied into the spinning device is fed by means of a feed roller 11 to a combing position B where it is opened out into individual fibers. The individual fibers are fed by a combing roller 2, which has a not shown fiber gripping surface to a doffing or removal position A through which they are introduced into a rotary spinning chamber of a rotor 12 where the fibers are spun and produce a yarn in a conventional manner. On the way of the fibers from the position B to A, there is provided a dirt discharge opening 3 in a housing wall of the feed roller 11 and combing roller 2 in order to allow dirt such as husks or neps of the sliver, which is denser thsn the fibers, to be thrown out by centrifugal force through the dirt discharge opening 3 into a dirt collecting chamber 4. The chamber 4 is provided with an air inlet 8 opening into the atmosphere and an air outlet 7 connected through a pipe 5 with a suitable source of negative pressure, shown schematically in FIG. 1 as 20. Therefore, an air current 9 is produced in the dirt collecting chamber 4, whereby the dirt can be removed from the chamber 4. Furthermore, to carry out an effective separation of the dirt particles from the sliver at the position of the dirt discharge opening 3, there is provided a separating channel 6 on the upstream side of the dirt discharge opening 3 with respect to the direction of fiber movement, the channel 6 being in communication with the atmosphere. An air current 13 flows through the separating channel 6 and is introduced into the fibers opposite to the direction of movement of the dirt particles out of the fibers to stop the fibers from passing out through the dirt discharge opening 3.

The separating channel 6 is provided in an exchangeable block member 14 which is disconnectably assembled in the housing of the feeding roller 11 and combing roller 2 so that the separating channel 6 preferably opens into the dirt collecting chamber 4 adjacent to the dirt discharge opening 3.

As described above, the amount of the fibers passing out through the dirt discharge opening 3 depend on various conditions, such as the circumferential speed of the combing roller 2, the magnitude of negative pressure supplied by the negative pressure source, the types of the material to be spun and so on. Therefore, in order to increase the production rate of the spun yarn, it is required that the separating channel 6 is appropriately adjusted so that an amount and (or) a direction of movement of air passing through the separating channel 6 are (is) suited to the above conditions.

Such requirements can be met by providing a plurality of separating channel defining block members 14 having various separating channels 6 different from one another in cross-sectional area and (or) angle of inclination. In the embodiment of FIG. 2, a block member 14*a* having a larger diameter of separating channel 6*a* is employed instead of the block member 14, to thus increase the amount of air passing through the separating channel 6*a*. In the embodiment of FIG. 3, a block member 14*b* having an inclined separating channel 6*b* is employed to change the angle of the direction of movement of the air current 13 with respect to the dirt discharge opening 3.

Alternatively, adjustment of the amount of air flowing into the fibers can be effected by providing the block member 14 with an adjusting valve means 15 (FIG. 4) positioned within the separating channel 6. the adjusting valve means 15 comprises a valve plate 16 mounted to a rotatable pin 17 which is supported at the opposite ends thereof by the wall of the block member 14 and adapted to be manually rotated outwardly of the block member 14 and to stop at any desired angular position to adjust the amount of air passing through channel 6.

FIG. 5 illustrates a further embodiment of the invention, in which a separating channel 6*c* extends through a plate member 14*c* connected to the housing by suitable fittings such as screws to cover an open side provided in dirt collecting chamber 4. The separating channel 6*c* is provided in the plate member 14*c* in such a manner that its center axis extends substantially parallel to the rotational axis of the combing roller 2 and it becomes substantially flush with the dirt discharge opening 3. The center axis of the separating channel 6*c* may be inclined with respect to the rotational axis of the combing roller 2. When it is desired to change an amount of air passing into the fibers, the plate member 14*c* is exchanged with a different one.

FIG. 6 shows an improvement to the embodiment of FIG. 5. Means is mounted to the plate member 14*c* for adjusting an area of the opening of the separating channel 6*c*. The adjusting means comprises a guide 6' and a slider 6'' slidable along the guide 6'.

In a further embodiment shown in FIG. 7, a disconnectable block member 14*d* defining a separating channel 6*d* is arranged on the downstream side of the dirt discharge opening 3 with respect to the direction of movement of the fibers. It is preferable to position the separating channel 6*d* near the dirt discharge opening 3 as far as possible, but the separating channel 6*d* is not always required to orient toward the dirt discharge opening 3.

From the foregoing, it will be understood that the present invention provides an improved spinning device in which separation of the dirt particles from the fibers can always be effected under the optimum conditions of the spinning device, thus preventing a degree of removal of dirt particles from being decreased below a particular level and the fibers from passing out through the dirt discharge, without decreasing a production rate of a spun yarn.

While the invention has been illustrated and described with reference to various specific embodiments thereof, it is to be understood that various changes in the details of construction may be accomplished without departing from the spirit and scope of the invention.

What I claim is:

1. A fiber spinning device comprising:

a rotary spinning chamber;

a housing;

means cooperating with said housing for combing a sliver into individual fibers and feeding said fibers along a path to said rotary spinning chamber;

means communicating with said housing for removing dirt from said fibers, said dirt removing means comprising a dirt discharge opening in said housing communicating with said path, a dirt collection chamber positioned in said housing to receive dirt passing through said discharge opening, said dirt collection chamber having an open side, an air inlet and an air outlet opening into said dirt collection chamber, and means connected to said air outlet for continously creating an air current through said dirt collection chamber to continuously remove dirt therefrom during the operation of said combing and feeding means; and separating channel means for supplying air to said path to prevent fibers from passing from said path through said dirt discharge opening, said separating channel means comprising a plate-shaped member having a channel therethrough, said plate-shaped member having a configuration to fit over and close said open side of said dirt collection chamber, such that when attached thereto said channel is positioned closely adjacent said dirt discharge opening opposite said combing and feeding means.

2. A device as claimed in claim 1, wherein said channel in said plate-shaped member extends therethrough in a direction parallel to a rotational axis of said combing and feeding means when said plate-shaped member is positioned over said open side wall.

3. A device as claimed in claim 1, wherein said plate-shaped member has on an outer surface thereof a movable slide means for covering a selectively variable portion of the cross-section of the said channel extending through said plate-shaped member.

* * * * *